US009141055B2

(12) United States Patent
Otsuka

(10) Patent No.: US 9,141,055 B2
(45) Date of Patent: Sep. 22, 2015

(54) FIXING UNIT AND IMAGE FORMING APPARATUS

(71) Applicant: Konica Minolta, Inc., Chiyoda-ku (JP)

(72) Inventor: Yutaka Otsuka, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/079,573

(22) Filed: Nov. 13, 2013

(65) Prior Publication Data

US 2014/0133880 A1 May 15, 2014

(30) Foreign Application Priority Data

Nov. 13, 2012 (JP) ..... 2012-249225

(51) Int. Cl.
*G03G 15/20* (2006.01)

(52) U.S. Cl.
CPC ..... *G03G 15/2078* (2013.01); *G03G 15/2039* (2013.01); *G03G 15/2042* (2013.01)

(58) Field of Classification Search
CPC ..... G03G 15/2078; G03G 15/2042
USPC ..... 399/70, 67, 69, 328, 334
See application file for complete search history.

(56) References Cited

U.S. PATENT DOCUMENTS

| | | | | |
|---|---|---|---|---|
| 5,041,718 | A * | 8/1991 | d'Hondt et al. | 219/255 |
| 2008/0131160 | A1* | 6/2008 | Mitsuoka et al. | 399/70 |
| 2011/0135334 | A1 | 6/2011 | Sato | |
| 2012/0308253 | A1* | 12/2012 | Kurata et al. | 399/69 |

FOREIGN PATENT DOCUMENTS

| | | | |
|---|---|---|---|
| JP | 08-220932 | A | 8/1996 |
| JP | 2004-286936 | A | 10/2004 |
| JP | 2011-118261 | A | 6/2011 |

OTHER PUBLICATIONS

Notification of Reason(s) for Refusal dated Oct. 14, 2014 issued in the corresponding Japanese Patent Application No. 2012-249225 and English language translation (7 pages).

* cited by examiner

*Primary Examiner* — Rochelle-Ann J Blackman
(74) *Attorney, Agent, or Firm* — Buchanan Ingersoll & Rooney PC

(57) ABSTRACT

A fixing unit includes a first heat source configured to heat a roller, and a second heat source configured to heat the roller. The maximum value of a total amount of heat generated in the second heat source is smaller than that of the first heat source. The second heat source has an amount of heat generated higher in ends of the second heat source than in a center thereof in a distribution of the amount of heat generated in the axial direction. The second heat source has a rate of the amount of heat generated in the ends of the second heat source to that in the center thereof higher than a rate of the amount of heat generated in the ends of the first heat source to that in the center thereof.

11 Claims, 14 Drawing Sheets

FIG. 6

| MODE | HEATER SELECTION CONTROL |
|---|---|
| WU | BOTH FIRST HEATER AND SECOND HEATER |
| WA | SECOND HEATER |
| PT | SWITCH BETWEEN FIRST HEATER AND SECOND HEATER |

FIXING UNIT AND IMAGE FORMING APPARATUS

This application is based on Japanese patent application No. 2012-249225 filed on Nov. 13, 2012, the contents of which are hereby incorporated by reference.

BACKGROUND OF THE INVENTION

1. Field of the Invention

The present invention relates to a fixing unit for fixing a toner image onto a recording sheet such as paper by applying heat to the recording sheet which passes through two rollers contacting each other, and relates to an image forming apparatus having such a fixing unit. The present invention is applied to various types of image forming apparatuses, e.g., a copier, a printer, a facsimile machine, and a combination machine thereof.

2. Description of the Related Art

Image forming apparatuses such as a printer and a copier, and multi-functional image forming apparatuses called combination machines or Multi Function. Peripherals (MFP) have conventionally been used. Such an image forming apparatus is provided with a fixing unit which applies heat to loose toner powder coated on a recording sheet such as paper through electrophotography to fix the same on the recording sheet.

The fixing unit includes a heated roller containing a heater therein along the axial direction of the heated roller, and a pressure roller provided to contact the heated roller for rotation. The fixing unit is so structured that paper or the like passes through a nip between the two rollers contacting each other.

There is proposed a device which has, as a heater (heat source) for heating a heated roller, two heaters differing from each other in distribution of the amount of heat generated in the length direction thereof. The two heaters are selectively used in the device (Japanese Laid-open Patent Publication No. 2011-118261).

To be specific, according to the device described in Japanese Laid-open Patent Publication No. 2011-118261, the two heaters of a main heater and a subordinate heater are provided. A switch temperature is stored for drive of the two rollers, and the switch temperature is compared with the temperature of a fixing roller, and depending on the comparison result, any one of the two rollers is selected and driven. Further, the method for switching between the two heaters is changed depending on whether the roller rotates or not. This reduces the maximum consumption power and falls the temperature within a predetermined range.

Meanwhile, in a fixing unit provided with a heated roller containing a single heater therein, heat escapes from the ends, in the axial direction, of the heated roller even in a standby mode in which no paper is conveyed. Thus, a tendency is seen in which temperature in the ends of the heated roller drops, in particular, in the standby mode. For this reason, immediately after the mode is changed from the standby mode to the print mode and paper feed starts, a fixing failure probably occurs due to the low temperature in the ends of the heated roller. In order to cope with this, it is necessary to, for example, set light distribution to (amount of heat generated in) the ends of the heater at a high value so as to prevent the temperature in the ends of the heated roller from dropping.

When a plurality of pieces of paper is continuously delivered in the print mode, heat of the heated roller is transferred from a part thereof corresponding to the paper width to the paper passing through the nip. As a result, the temperature of the heated roller drops. To cope with this, control (heater control) is made in such a manner that a heated time (ON time) of the heater is extended to prevent the temperature of the heated roller from dropping. In such a case, the temperature in the ends of the heated roller corresponding to outer regions beyond the paper width does not drop because no heat is transferred to the paper, and further, heat is conducted from the center of the heated roller to the outer regions. Further, the temperature in the ends of the heated roller is increased because the heated time thereof is increased.

Such a problem occurs not only in a fixing unit having a single heater, but probably in a fixing unit having a plurality of heaters corresponding to paper size as disclosed in Japanese Laid-open Patent Publication No. 2011-118261.

To be specific, in conventional fixing units, when a plurality of pieces of paper is continuously delivered in the print mode, the temperature in the ends of the roller rises greatly. In the case where silicone rubber is used in the fixing unit, Ultra-Fine Particles (UFP) having a size equal to or smaller than 100 nm tend to be generated. It is desirable to minimize the amount of generation of the UFP.

SUMMARY

The present disclosure is directed to solve the problems pointed out above, and therefore, an object of an embodiment of the present invention is to provide a fixing unit configured to reduce temperature drop in the ends of a roller at the start of paper feed, and to reduce temperature rise in the ends of the roller during continuous paper feed.

A fixing unit according to one aspect of the present invention, is a fixing unit for applying heat to a recording sheet passing through two rollers contacting each other to fix toner onto the recording sheet. The fixing unit includes a first heat source configured to heat any one of the rollers, the first heat source having an amount of heat generated higher in ends of the first heat source than in a center thereof in a distribution of the amount of heat generated in an axial direction of any one of the rollers; and a second heat source configured to heat any one of the rollers, a maximum value of a total amount of heat generated in the second heat source being smaller than that of the first heat source, the second heat source having an amount of heat generated higher in ends of the second heat source than in a center thereof in a distribution of the amount of heat generated in an axial direction of any one of the rollers, and the second heat source having a rate of the amount of heat generated in the ends of the second heat source to that in the center thereof higher than a rate of the amount of heat generated in the ends of the first heat source to that in the center thereof.

These and other characteristics and objects of the present invention will become more apparent by the following descriptions of preferred embodiments with reference to drawings.

BRIEF DESCRIPTION OF THE DRAWINGS

FIG. 6 is a diagram showing an example of heater selection control.

DESCRIPTION OF THE PREFERRED EMBODIMENTS

Figure 1:
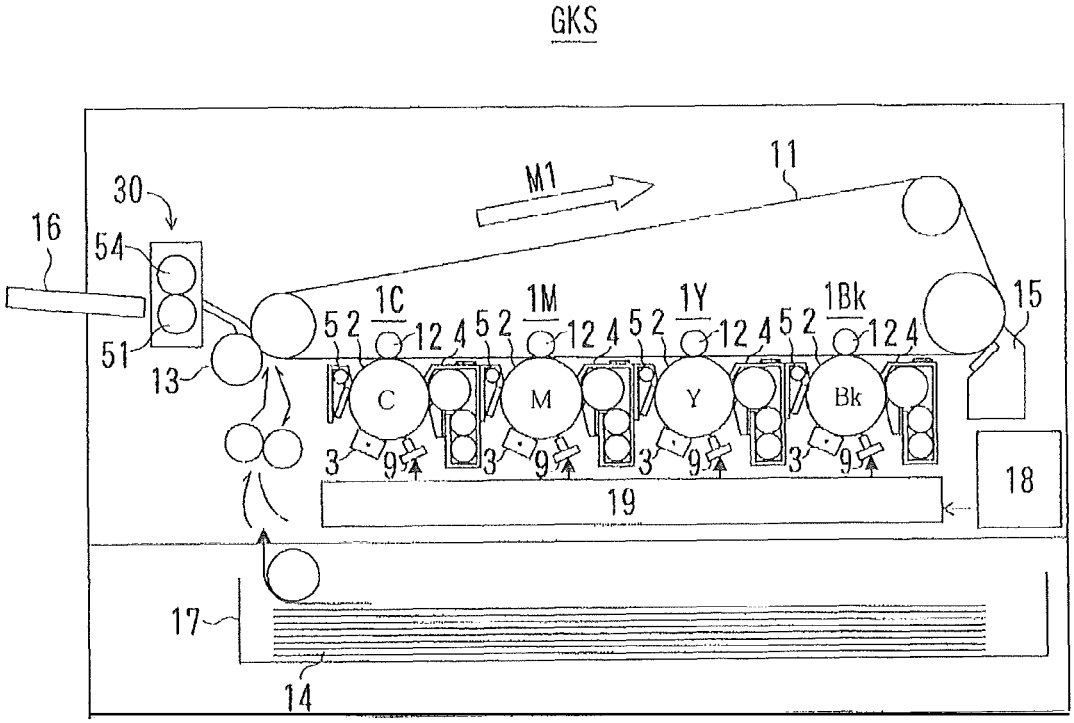
FIG. 1 is a schematic diagram showing an example of the inner structure of an image forming apparatus according to an embodiment of the present invention.

FIG. 1 is a schematic diagram showing an example of the inner structure of an image forming apparatus GKS according to an embodiment of the present invention. FIG. 1 shows a full-color printer as an example of the image forming apparatus GKS. Instead of this, the image forming apparatus GKS may be another device such as a facsimile machine, a copier, or an MFP.

Referring to FIG. 1, the image forming apparatus GKS includes image forming units 1Bk, 1Y, 1M, and 1C for forming toner images of black (Bk), yellow (Y), magenta (M), and cyan (C), respectively. The image forming units 1Bk, 1Y, 1M, and 1C are disposed in the stated order from the upstream along an intermediate transfer belt 11 which runs in the direction indicated by the arrow M1.

The image forming units 1Bk, 1Y, 1M, and 1C have almost the same structure. To be specific, each of the image forming units 1Bk, 1Y, 1M, and 1C includes a photoconductive drum 2, a charging portion 3 for uniformly charging the photoconductive drum 2, an exposure portion 9 for performing image exposure onto the charged photoconductive drum 2, and a developer portion 4 for using toner of the corresponding color to perform development on an electrostatic latent image formed through the image exposure.

The toner image is developed on the photoconductive drum 2 of each of the image forming units 1Bk, 1Y, 1M, and 1C. Each of the primary transfer portions 12 transfers the toner image onto the intermediate transfer belt 11 at a position where the primary transfer portion 12 contacts the intermediate transfer belt 11. The residual toner on the photoconductive drum 2 after the primary transfer is removed by the cleaning portion 5 provided in the downstream and collected in the bottom of the cleaning portion 5.

When the toner image transferred onto the intermediate transfer belt 11 passes the image forming units 1Bk, 1Y, 1M, and 1C, the colors corresponding thereto are overlaid on the toner image. As a result, the full-color toner image is formed on the intermediate transfer belt 11.

The full-color toner image on the intermediate transfer belt 11 is then transferred onto paper 14 at downstream by a secondary transfer portion 13. The paper 14 onto which the toner image has been transferred passes through a fixing unit 30 provided above. Thereby, the toner image is fixed onto the paper 14 and the paper 14 is outputted to a paper output tray 16.

The fixing unit 30 is provided with a heated roller 51 and a pressure roller 54 that is disposed to rotate in contacting relation with the heated roller 51. The fixing unit 30 is so structured that the paper 14 passes through a nip NB formed at a contact part of the heated roller 51 and the pressure roller 54. Instead of the pressure roller 54, a pressure belt may be used in the fixing unit 30.

Pieces of paper 14 are held in a paper cassette 17 provided at the bottom of the image forming apparatus GKS. The pieces of paper 14 are conveyed one by one from the paper cassette 17 to the transfer portion 13. The toner remaining on the intermediate transfer belt 11 after the secondary transfer is removed by a cleaning blade 15. The toner thus removed is conveyed by a screw conveyor (not shown), and is gathered in a waste toner container.

A control unit 18 controls the entirety of the image forming apparatus GKS. For example, the control unit 18 sends signals depending on image to the exposure control unit 19. The exposure control unit 19 drives the exposure portions 9 depending on the color.

The control unit 18 also controls the fixing unit 30 through the fixing control unit 20. Thereby, temperature drop in the ends of the heated roller at the start of paper feed is minimized, and temperature rise in the ends of the heated roller at the time of continuous paper feed is also minimized. The details are described later.

In this embodiment, the paper 14 is taken as an example of the recording sheet. The material of the recording sheet or the sheet is not limited to paper. The size and shape of the recording sheet or the sheet is not limited to the foregoing example and any sheet is available, provided that a toner image can be formed on and fixed to the sheet.

Figure 2A:
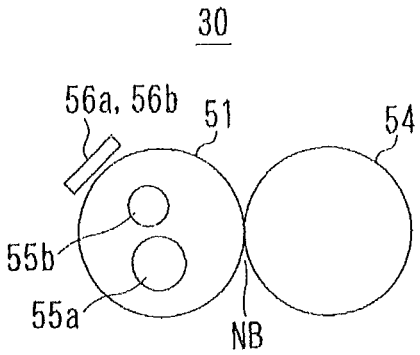
FIGS. 2A and 2B are diagrams showing an example of the inside of a heated roller provided in a fixing unit.
Figure 2B:
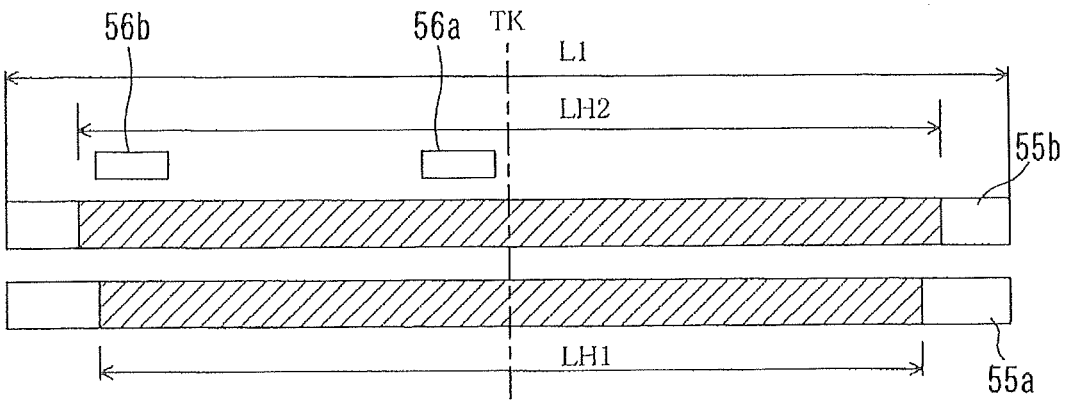
Figure 3A:
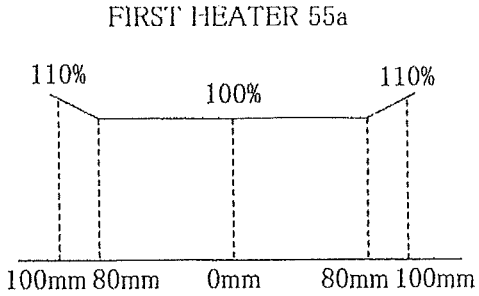
FIGS. 3A and 3B are diagrams showing an example of a temperature distribution of heaters of a heated roller.
Figure 3B:
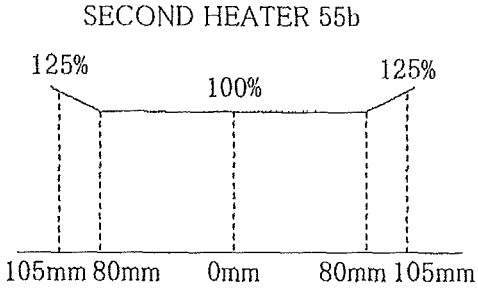

FIG. 2A shows an example of the internal structure of the heated roller 51 of the fixing unit 30, and FIG. 2B shows an example for explanation of heated regions of heaters. FIGS. 3A and 3B show an example of a temperature distribution in the axial direction of the heaters.

Referring to FIG. 2A, in the heated roller 51, two heaters of a first heater 55*a* and a second heater 55*b* are attached in the axial direction of the heated roller 51. Hereinafter, both or either one of the first heater 55*a* and the second heater 55*b* is sometimes referred to as a "heater 55".

The heater 55 is a halogen lamp heater. The amount of heat generated in the heater 55 is substantially proportional to the power supplied thereto. Since the power rating of each of the heaters is preset, the heaters cannot be supplied with power beyond the power rating. For example, when the heater 55 is supplied with power equal to the power rating, the amount of heat generated therein becomes a maximum value.

As shown in FIG. 2B, the heaters 55*a* and 55*b* have the same length Ll. The heater 55*a* and 55*b*, however, have heated lengths LH1 and LH2 respectively which are different from each other. To be specific, the heated length LH2 in the second heater 55*b* is slightly longer than the heated length LH1 in the first heater 55*a*.

In this embodiment, the heated length LH1 in the first heater 55*a* is, for example, 200 mm, while the heated length LH2 in the second heater 55*b* is, for example, 210 mm. The maximum size of paper on which the image forming apparatus GKS of this embodiment can perform printing is A4-size, portrait orientation. The heated lengths LH1 and LH2 are determined in accordance with the width of A4-size paper, i.e., 210 mm, and the width of letter-sized paper, i.e., 215.9 mm, respectively.

Stated differently, in this embodiment, the second heater 55*b* has a heated region substantially equal to the maximum width size of the paper 14, and the first heater 55*a* has a heated region slightly smaller than that of the second heater 55*b*.

Instead of this, the heated length LH1 in the heater 55*a* may be equal to the heated length LH2 in the heater 55*b*.

In the image forming apparatus GKS of this embodiment, the paper 14 may have a size smaller than A4-size, e.g., may have A5-size, portrait orientation. When the paper 14 is A5-size and loaded in portrait orientation, the heated lengths LH1 and LH2 in the heater 55 are longer than the paper width of the paper 14. The heater 55 is therefore sometimes referred to as a "long heater".

In this embodiment, the amount of heat generated in the axial direction (length direction) of each of the heaters 55*a* and 55*b* is not distributed uniformly. The distribution states are different between the heaters 55*a* and 55*b*.

To be specific, in the distribution of the amount of heat generated in the axial direction of the first heater 55*a*, the amount of heat generated is higher in the ends of the first heater 55*a* than in the center thereof. The second heater 55*b* has the maximum value of the total amount of heat generated, i.e., the power rating, smaller than that of the first heater 55*a*. In the distribution of the amount of heat generated in the axial direction of the second heater 55*b*, the amount of heat generated is higher in the ends of the second heater 55*b* than in the center thereof. Further, the rate of the amount of heat generated in the ends of the second heater 55*b* to that in the center thereof is higher than that in the first heater 55*a*.

Referring to FIG. 3A, it is supposed that a rate WA of the amount of heat generated in the center of the first heater 55*a* per a unit length is 100%. In such a case, a rate WA of the amount of heat generated in the ends thereof is 110% or more. It is possible to set the rate WA in the ends of the first heater 55*a* at 108%, 115%, 120%, or another value. In the illustrated example, the distribution of the amount of heat generated is symmetrical, and the rate WA linearly increases starting from the position 20 mm away from each of the ends toward the ends of the first heater 55*a*.

Referring to FIG. 3B, it is supposed that a rate WA of the amount of heat generated in the center of the second heater 55*b* per a unit length is 100%. In such a case, a rate WA of the amount of heat generated in the ends thereof, is 125% or more. It is possible to set the rate WA in the ends of the second heater 55*b* at 122%, 128%, 130%, or another value. In the illustrated example, the distribution of the amount of heat generated is symmetrical, and the rate WA linearly increases starting from the position 25 mm away from each of the ends toward the ends of the second heater 55*b*.

By way of example, FIGS. 3A and 3B show the distribution of the amount of heat generated in which the rate WA increases linearly. The distribution is not limited thereto, and may be a distribution in which the rate WA increases in the form of curve or steps.

In this embodiment, the power rating of the first heater 55*a* is 900 W and the power rating of the second heater 55*b* is 400 W, which means that the power rating of the second heater 55*b* is not greater than a half of the power rating of the first heater 55*a*. The power rating of the second heater 55*b* is not limited thereto, and may be approximately a half of the power rating of the first heater 55*a*, approximately two thirds thereof, approximately three fourths thereof, or approximately 80% thereof provided that the power rating of the second heater 55*b* is smaller than that of the first heater 55*a*.

In this embodiment, the structure and size of the heated roller 51 are, for example, as follows: The outer diameter is 26 mm, the thickness of an iron hollow core metal of the heated roller 51 is 0.45 mm, the thickness of rubber of the surface of the heated roller 51 is 560 μm, and the thickness of a coated PFA (fluororesin) is 40 μm. The structure and size of the pressure roller 54 are, for example, as follows: The outer diameter is 30 mm, the thickness of a PI (polyimide resin) is 80 μm, and the thickness of a coated PFA (fluororesin) is 30 μm.

The fixing unit 30 is provided with a first temperature sensor 56*a* for detecting a temperature around the center of the heated roller 51, and a second temperature sensor 56*b* for detecting a temperature in the ends thereof. The first temperature sensor 56*a* is disposed at a position 10 mm away from a paper teed reference position TK that is the center of the heated roller 51 in the axial direction thereof. The second temperature sensor 56*b* is provided at a position 90 mm away from the paper feed reference position TK.

Each of the temperature sensors 56*a* and 56*b* is a thermistor, and provided not to contact the heated roller 51.

Figure 4:
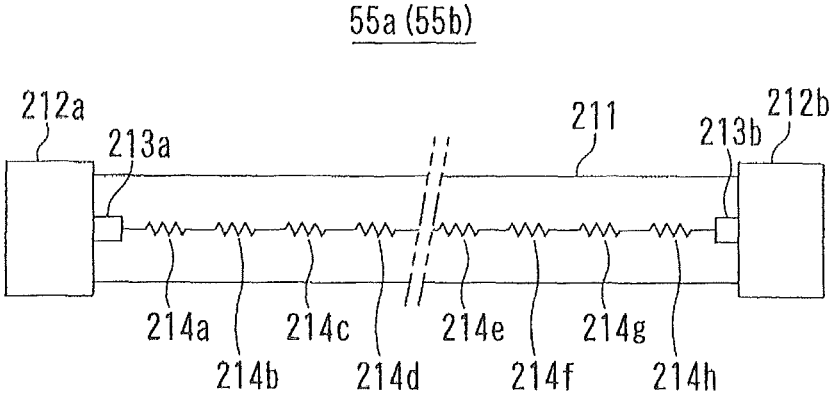
FIG. 4 is a diagram showing an example of the structure of a heater.

FIG. 4 shows an example of the structure of the heater 55.

Referring to FIG. 4, the heater 55 includes a glass tube 211 which has, on its ends, caps 212*a* and 212*b* and electrodes 213*a* and 213*b*. Inside the glass tube 211, heat generating coils 214*a*, 214*b*, 214*c*, and so on made of resistance wire are connected in series, supported by a non-illustrated supporter, and fixed to the glass tube 211. The heat generating coils 214*a* and 214*h* provided in the ends have coil turns more than the other heat generating coils 214*b*, 214*c*, 214*g*, and so on. Therefore, the amount of heat generated in each of the heat generating coils 214*a* and 214*h* is greater than that in the other heat generating coils. The length and coil turns of the coils are adjusted, or, the coil turns of one coil are adjusted, so that the heater 55 having the distribution of the amount of heat generated shown in FIGS. 3A and 3B can be implemented.

Figure 5:
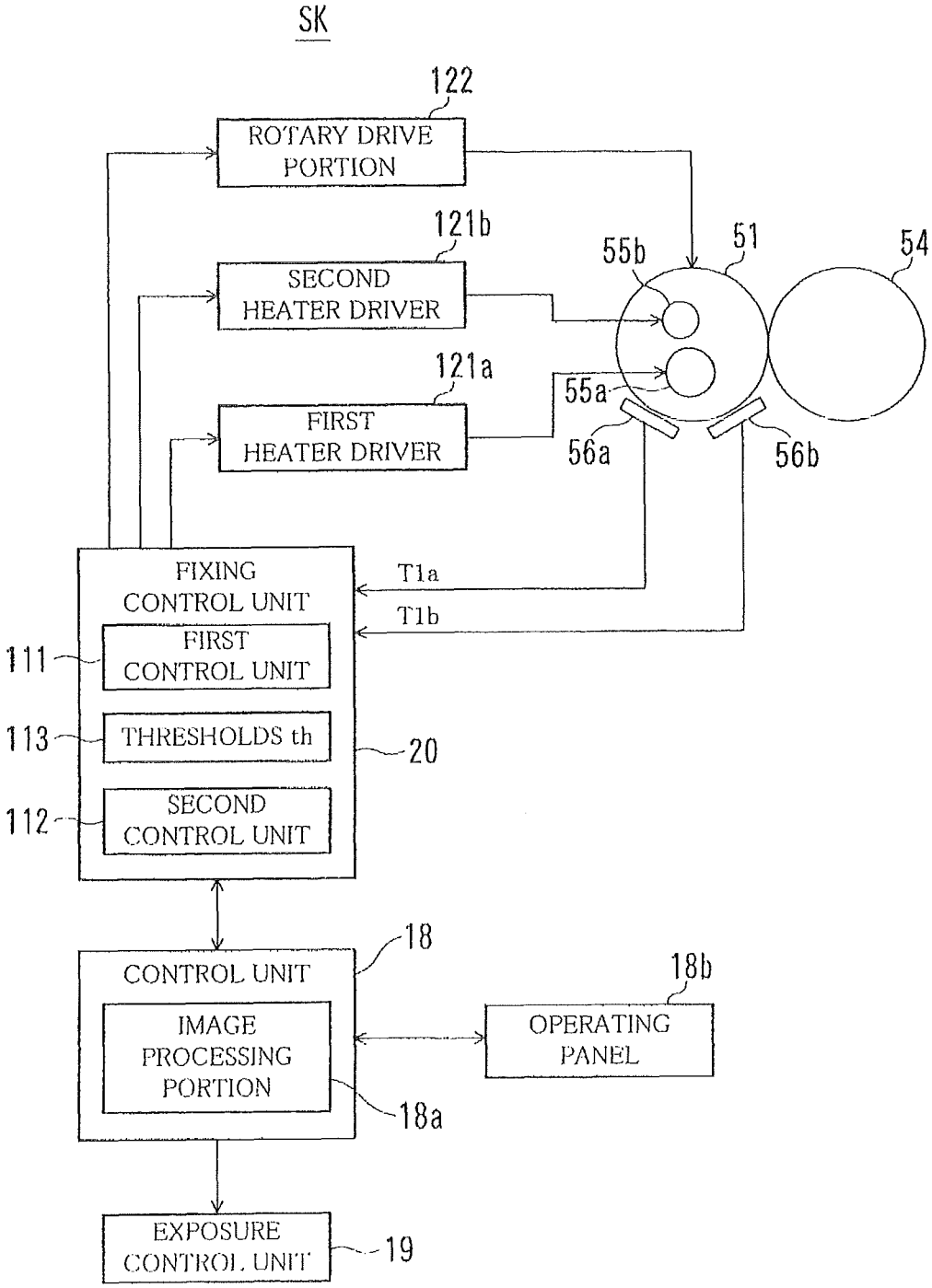
FIG. 5 is a block diagram showing an example of the configuration of the principal part of a control system in an image forming apparatus.

FIG. 5 shows an example of the configuration of the principal part of a control system SK in the image forming apparatus GKS of this embodiment.

As shown in FIG. 5, the control system SK is provided with the control unit 18, the exposure control unit 19, and the fixing control unit 20. The fixing control unit 20 has a first control unit 111, a second control unit 112, and a storage portion 113 for storing thresholds th1-th4 therein. The fixing control unit 20 serves to control the temperature of the heater 55 in the fixing unit 30, control the rotary drive of the heated roller 51 and the pressure roller 54, and so on.

Referring to FIG. 5, the first heater driver 121*a* supplies controlled power to the first heater 55*a*. The second heater driver 121*b* supplies controlled power to the second heater 55*b*. The first heater driver 121*a* and the second heater driver 121*b* perform phase control on AC power supplied from the power source based on a command from the fixing control unit 20, and controls the power to be supplied to the first heater 55*a* and the second heater 55*b*. In essence, each of the first heater driver 121*a* and the second heater driver 121*b* is taken as an example of a "power supplying portion" in the present invention.

The first heater driver 121*a* and the second heater driver 121*b* use the following methods for controlling power, for example: The phase control in which a phase (time) of turning the AC power ON/OFF is controlled; the pulse width control in which the pulse width of "ON" time or "OFF" time is controlled; and the wave number control in which the number of half waves to be turned ON during a unit period of time is controlled. In the case where the heat source is an induction heating coil rather than the heater 55, the frequency, voltage, or the like can be controlled.

First temperature T1*a* detected by the first temperature sensor 56*a* and second temperature T1*b* detected by the second temperature sensor 56*b* are inputted to the fixing control unit 20.

The control unit 18 is provided with an image processing portion 18*a* which performs various processing on input image data. The control unit 18 is also provided with an operating panel 18*b* which is used for a user to enter various commands and settings into the image forming apparatus GKS, and is used to display messages and a state of the image forming apparatus GKS.

As operational modes of the image forming apparatus GKS, a warm up mode (WU mode), a standby mode (WA mode), and a print mode (PT mode) are prepared for example. The examples of operation in the individual modes are described below.

After being turned ON, the image forming apparatus GKS enters the warm up mode in which the heater 55 is heated, the CPU and so on are initialized, a check is made whether something unusual occurs or not, and preparation processing for obtaining set values for forming an image is performed. In the warm up mode, the temperature of the heated roller 51 is increased as quickly as possible. When the temperature of the heated roller 51 reaches, for example, a first threshold th1, namely, approximately 170° C., and the other preparation processing is completed, the image forming apparatus GKS exits the warm up mode to turn into the standby mode or the print mode.

After being completely warned up, the image forming apparatus GKS enters the standby mode in which entry of a print command is waited. In the standby mode, the heater 55 is controlled in such a manner that the temperature of the heated roller 51 is kept within a range of, approximately, 170-190° C.

Under the print mode, in response to a print command entered by a user, the image forming apparatus GKS performs printing (forms an image) onto the paper 14. The print command is entered, for example, when the user presses a "START" key or a "COPY" key, or, when print data is sent from a user terminal via a communication line. In the print mode, the heater 55 is controlled in such a manner that the temperature of the heated roller 51 reaches approximately 190° C. or greater. The initial conditions for turning the image forming apparatus GKS from the standby mode into the print mode are, for example, that the temperature of the heated roller 51 reaches a set value, e.g., approximately 180° C. or greater.

Another configuration is possible in which, in the warm up mode, the target value of the temperature (target temperature) of the heated roller 51 is set at approximately 190° C. under which printing is possible (fixing is possible). In such a case, it is possible to finish the warm up mode at a time when the temperature of the heated roller 51 reaches, for example, approximately 170° C. as the first threshold th1. Another configuration is possible in which, when a print command is entered in the warm up mode, the image forming apparatus CKS exits the warm up mode and directly turns into the print mode, provided that the other preparation processing is completed.

Various operation other than those above may be performed in the individual modes.

The control under the individual modes is performed mainly based on the first temperature T1*a* detected by the first temperature sensor 56*a*. The second temperature T1*b* detected by the second temperature sensor 56*b* is auxiliary used for the control.

Each of the first heater driver 121*a* and the second heater driver 121*b* may include a switching circuit using a bi-directional thyristor, a transistor, or the like. The switching circuit may be a known circuit or a known element.

A rotary drive portion 122 drives the rotation of rollers including the heated roller 51 to control the rotation, stop, rotational direction, rotational speed, rotational timing, and so on of the rollers based on a command from the fixing control unit 20. The rotary drive portion 122 may be formed of a motor, a drive control circuit for controlling the driving of the motor, a gear, a belt, a clutch, and so on.

The first control unit 111 performs the control in such a manner that, under the warm up mode, both the first heater 55*a* and the second heater 55*b* are selected and supplied with power, under the standby mode, only the second heater 55*b* is selected and supplied with power, and under the print mode, either one of the first heater 55*a* and the second heater 55*h* is selected and supplied with power (corresponding to claim 2 of the present invention).

FIG. 6 shows an example of such heater selection control by the first control unit 111.

As described above, in the warm up mode, both the first heater 55*a* and the second heater 55*b* are selected and supplied with power, which shortens the Lime required for the image forming apparatus GKS to be warmed up. In the standby mode, the second heater 55*b* which has a high rate WA of the amount of heat generated at the ends thereof per unit length is selected and the heated roller 51 is heated up. Therefore, temperature drop in the ends of the heated roller 51 is minimized.

In the print mode, an appropriate heater is selected from among the first heater 55*a* and the second heater 55*b* to heat the heated roller 51. Therefore, temperature rise in the ends of the heated roller 51 is minimized.

In this embodiment, the description such as "the first heater 55*a* is selected" means supplying power to the first heater 55*a*. The amount of power to be supplied thereto is different depending on the mode at that time, and the temperatures T1*a* and T1*b* detected. In the Specification, the description "the first heater 55*a* is selected" may be expressed in different ways such as "the first heater 55*a* is turned ON" and "the first heater 55*a* is supplied with power".

Accordingly, when the "first heater 55*a* is selected", the first heater driver 121*a* supplies power to the first heater 55*a*, performs phase control, and controls the amount of power to be supplied. In such a case, the amount of power to be supplied to the first heater 55*a* is adjusted through the phase control in such a manner that the temperature in accordance with the mode is kept.

The first control unit 111 controls the first heater driver 121*a* and the second heater driver 121*b* in such a manner that the image forming apparatus GKS turns from the warm up mode into the standby mode at a time when the first temperature T1*a* detected by the first temperature sensor 56*a* reaches the first threshold th1 or greater, and, in a state where the image forming apparatus GKS turns into the print mode in response to entry of a print mode command, the first temperature T1*a* reaches the second threshold th2 set as the target temperature or greater, so that the amount of power to be supplied to the first heater 55*a* or the second heater 55*b* is adjusted (corresponding to claim 3 of the present invention).

In the print mode, the first control unit 111 selects the first heater 55*a* at steady state, the first control unit 111 selects the second heater 55*b* at a time when the second temperature T1*b* detected by the second temperature sensor 56*b* is not more than the third threshold th3 (T1*b*≤th3), or, at a time when the second temperature T1*b* is reduced to be smaller than the first temperature T1*a* and a difference SB (=T1*a*−T1*b*) therebetween is not less than the fourth threshold th4 (SB≥th4) (corresponding to claim 4 of the present invention).

In this way, at steady state in the print mode, the first heater 55*a* which has a low rate WA of the amount of heat generated in the ends thereof per unit length is selected. Accordingly, temperature rise in the ends of the heated roller 51 while a plurality of pieces of paper is continuously fed can be minimized. This prevents the UFP from being generated.

When the temperature in the ends of the heated roller 51 drops, the second heater 55*b* which has a high rate WA of the amount of heat generated in the ends thereof is selected. This minimizes the temperature drop in the ends of the heated roller 51.

The third threshold th3 may fall within a range of, for example, approximately 170-190° C., namely, may be approximately 180° C. The fourth threshold th4 may fall within a range of, for example, approximately 5-15° C., namely, may be approximately 10° C.

The first control unit 111 performs the control in such a manner that the first heater 55*a* is selected at steady state in the print mode, and, the second heater 55*b* is selected when an interval (time interval or space) between a piece of paper 14 passing through the rollers and the next piece of paper 14 passing therethrough is greater than a predetermined value (corresponding to claim 5 of the present invention).

Thereby, temperature drop in the ends of the roller due to the large interval between the pieces of paper passing through the rollers is reduced. To be specific, the large interval between the pieces of paper passing through the rollers reduces the heat transfer from the heated roller 51 to the paper 14 and the amount of power to be supplied to the heater 55 is reduced, so that the temperature in the ends of the heated roller 51 drops easily. When the second heater 55*b* is selected, the amount of heat generated in the ends of the heated roller 51 is greater than that in the center thereof, so that temperature drop in the ends of the heated roller 51 is reduced.

The second control unit 112 performs the control in such a manner that the rollers such as the heated roller 51 are stopped in the standby mode, the rollers are rotated in the print mode, and the rollers are stopped after the last piece of paper 14 passes through the rollers in the print mode and after a predetermined of time has elapsed since the image forming apparatus GKS turned into the standby mode from the print mode (corresponding to claim 7 of the present invention).

In this way, temperature rise due to the stop of rotation of the heated roller 51 can be prevented.

Meanwhile, the first through fourth thresholds th1-th4 are stored in the storage portion 113 in advance. The user or maintenance staff may set or change the first through fourth thresholds th1-th4.

The description goes on to operation of the fixing unit 30. The description includes another control example aside from the foregoing control example.

When being turned ON, the image forming apparatus GKS enters the warm up mode and the heater 55 is so controlled that the temperature on the surface of the heated roller 51 reaches a predetermined temperature. Warm up time is the time that elapses before the image forming apparatus GKS is completely warmed up is. The warm up is performed when the image forming apparatus GKS is turned ON again, recovered from jam processing, recovered from the sleep mode, or when the cover of the body of the image forming apparatus GKS is closed.

Under the warm up mode, in order to raise the temperature of the heated roller 51 up to a printable temperature (fixing possible temperature), e.g., up to 190° C., both the first heater 55*a* and the second heater 55*b* are selected and turned ON. The preset temperature of the heated roller 51 in the warm up mode, i.e., the second threshold th2, is 190° C. for example. The heater 55 is controlled with the first temperature T1*a* detected by the first temperature sensor 56*a* used as the input.

The second control unit 112 controls the rotary drive portion 122 to rotate the heated roller 51, which followed by the rotation of the pressure roller 54. The heat generated in the heated roller 51 is then transferred to the surface of the pressure roller 54. At this time, the linear speed of the paper 14 by the rotation of the heated roller 51 is, for example, 185 mm/s. The temperature of the surfaces of the heated roller 51 and the pressure roller 54 is increased up to the printable temperature by turning ON (selecting) the heater 55 and the rotation.

When the first temperature T1*a* detected by the first temperature sensor 56*a* reaches a predetermined temperature (second threshold th2), a ready flag is set to show that the image forming apparatus GKS is ready to perform printing. The second threshold th2 for this case is 190° C., for example, and may be set at 170° C. When receiving a print command, the image forming apparatus GKS enters the print mode to start print operation (image forming operation). When not receiving a print command, the image forming apparatus GKS enters the standby mode.

In the standby mode, the rotation of the heated roller 51 is stopped. In the standby mode, the control is performed with the second heater 55*b* selected. The minimum preset temperature in the standby mode is, for example, 170° C., and the second heater driver 121*b* is controlled to supply power to the second heater 55*b*.

In the standby mode, it is possible to change the preset temperature depending on the temperature of the heated roller 51, or the internal temperature of the fixing unit 30 or the image forming apparatus GKS. Since the heat source is provided in the heated roller 51, the temperature of the heated roller 51 is higher than that of the pressure roller 54. The heated roller 51 is stopped in the standby mode; therefore, heat transfer to the pressure roller 54 is minimized, so that the amount of power supplied to the heater 55 is reduced. However, heat escapes from the ends of the heated roller 51. Thus, the difference S8 in temperature between the ends of the heated roller 51 and the center thereof is smaller than that for the case where the roller is rotated.

In the print mode, the heated roller 51 starts to be rotated before printing is started and the paper 14 is conveyed to the heated roller 51. Thereby, heat of the heated roller 51 is transferred to the surface of the pressure roller 54 to raise the temperature thereof. At the start of the rotation of the heated roller 51, the temperature of the heated roller 51 drops temporarily. It is supposed that the paper 14 is plain paper and full color printing is performed on the paper 14. In such a case, the linear speed of the paper 14 in the fixing unit 30 is, for example, 185 mm/s, the preset temperature (second threshold th2) is, for example, 190° C., and the first heater driver 121*a* is controlled to supply power to the first heater 55*a*.

In the print mode, it is possible to change the preset temperature depending on the temperature of the heated roller 51, or the internal temperature of the fixing unit 30 or the image forming apparatus GKS. In the print mode, the power is supplied for recovery from the state where the temperature dropped, and the power is also supplied for compensation for the amount of heat drawn by the paper 14 due to paper feed. Therefore, the amount of power to be supplied (rate of heater ON) is higher in the print mode than in the standby mode.

When the roller rotation stop state in the standby mode is compared with the roller rotating state in the print mode, the necessary amount of power to be supplied is greater in the standby mode than in the print mode for the case where the temperature in the ends of the heated roller 51 is maintained at the same temperature.

For control by the fixing control unit 20, the temperature T1 (T1*a*, T1*b*) detected by the first temperature sensor 56*a* and the second temperature sensor 56*b* is used. Instead of this, temperature obtained by correcting the temperature T1 (T1*a*, T1*b*) (post-correction temperature) may be used for the control.

To be specific, the post-correction temperature TA1 (TA1*a*, TA1*b*) expressed by the following equation (1) may be used.

$$TA1=A1\times T1 \quad (1)$$

wherein A1 represents a temperature adjustment correction coefficient. The control may be performed by using the post-correction temperature.

The description goes on to a flow of the outline of control performed in the image forming apparatus GKS with reference to flowcharts.

Figure 7:
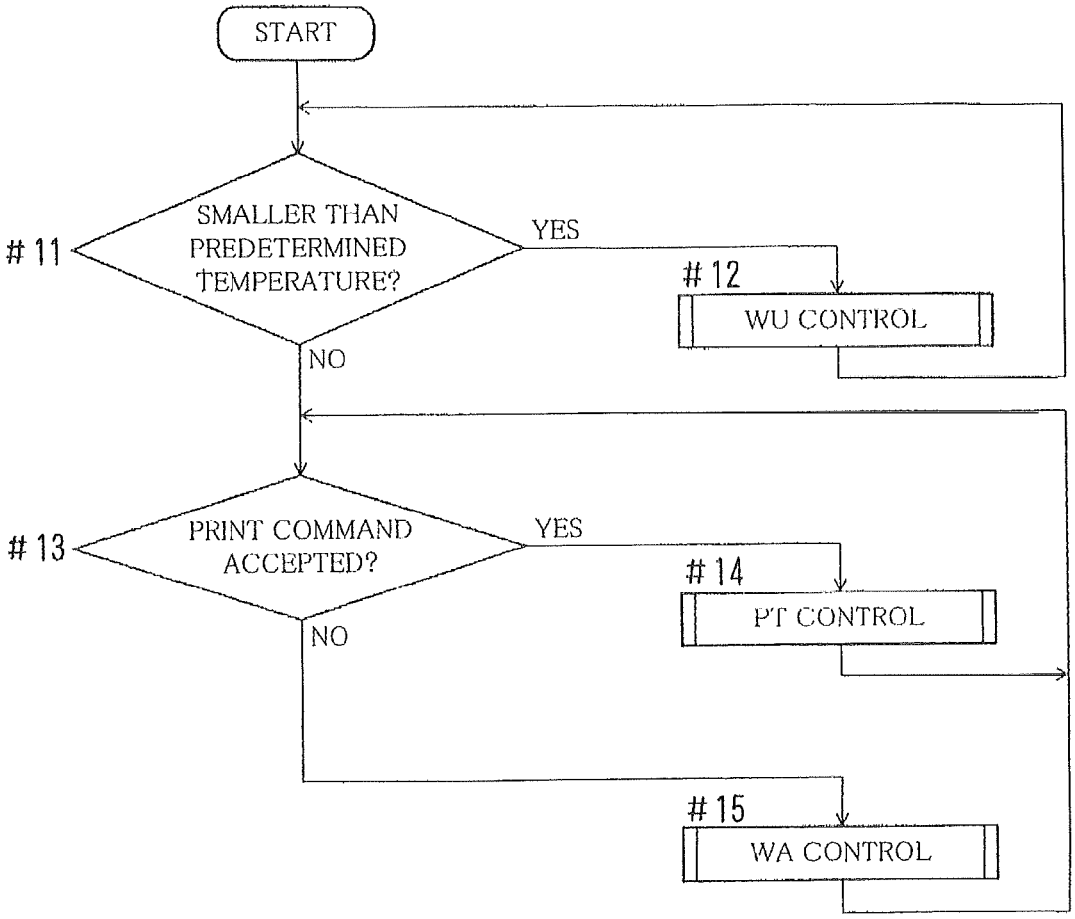
FIG. 7 is a flowchart depicting an example of the outline of control performed in an image forming apparatus.

Referring to FIG. 7, after the image forming apparatus GKS is turned ON, control in the warm up mode is performed until the first temperature T1*a* detected by the first temperature sensor 56*a* reaches a predetermined temperature (first threshold th1) (Step #11 and Step #12).

When the first temperature T1*a* reaches the first threshold th1 (Yes in Step #11), control in the standby mode is performed until a print command is entered (No in Step #13, and Step #15). When a print command is entered and accepted, control in the print mode is performed (Yes in Step #13, and Step #14).

Figure 8:
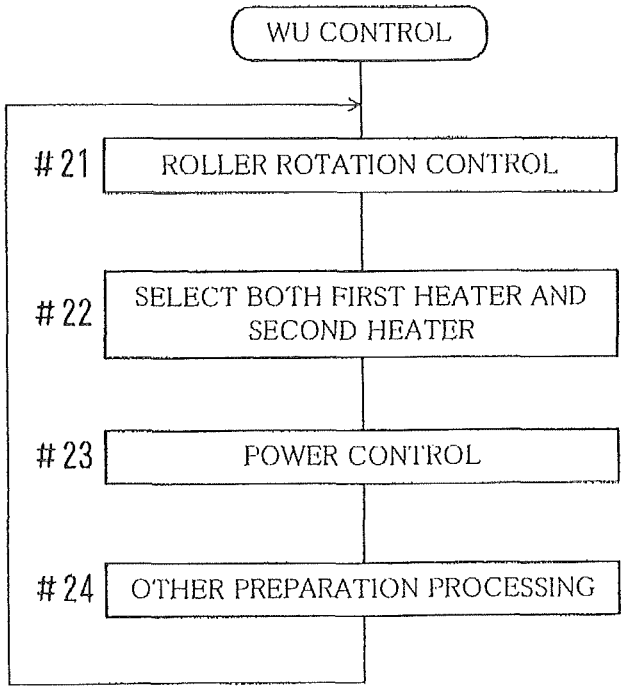
FIG. 8 is a flowchart depicting an example of the outline of WU control.

Referring to FIG. 8, in the warm up mode, rotation control is so performed that the rollers rotate at an appropriate time (Step #21). Both the first heater 55*a* and the second heater 55*b* are selected (Step #22). Power control is so performed to raise the temperature of the heated roller 51 quickly (Step #23). The other preparation processing is performed (Step #24).

Figure 9:
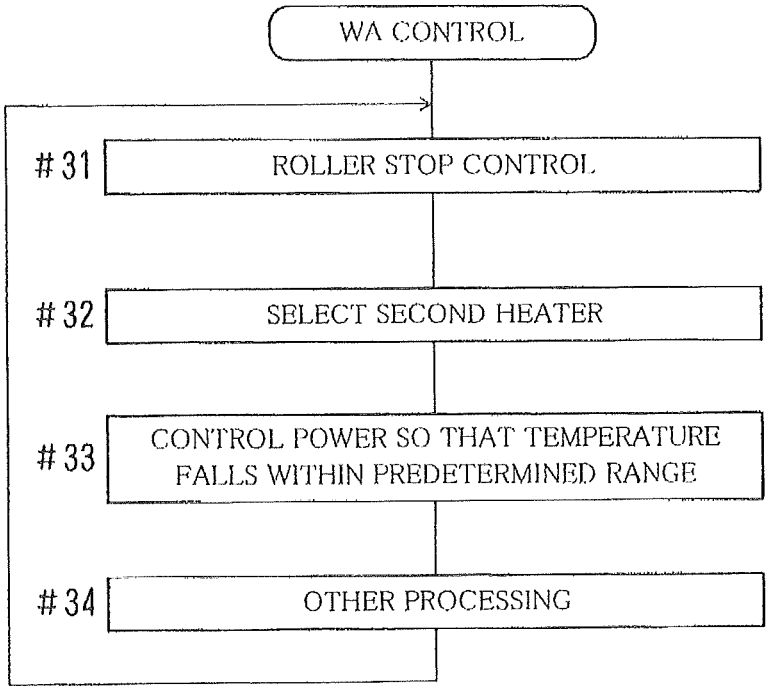
FIG. 9 is a flowchart depicting an example of the outline of WA control.

Referring to FIG. 9, in the standby mode, stop control is performed to stop the roller (Step #31). The second heater 55*b* is selected (Step #32). Power control is performed in such a manner that the temperature of the heated roller 51 falls within a predetermined range (Step #33). The other processing is performed (Step #34).

Figure 10:
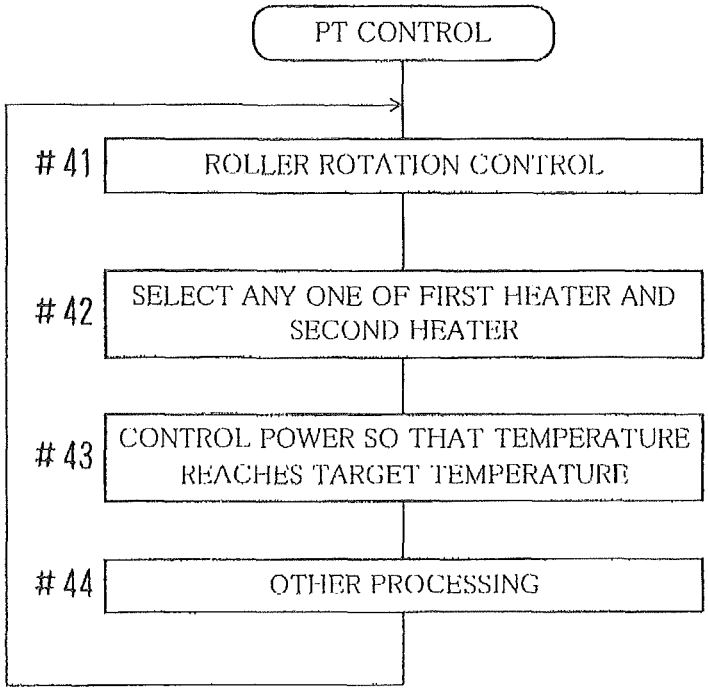
FIG. 10 is a flowchart depicting an example of the outline of PT control.

Referring to FIG. 10, in the print mode, rotation control is so performed that the rollers rotate at an appropriate time (Step #41). Any one of the first heater 55*a* and the second heater 55*b* is selected (Step #42). Power control is so performed that the temperature of the heated roller 51 reaches the target temperature (Step #43). The other processing is performed (Step #44).

Figure 11:
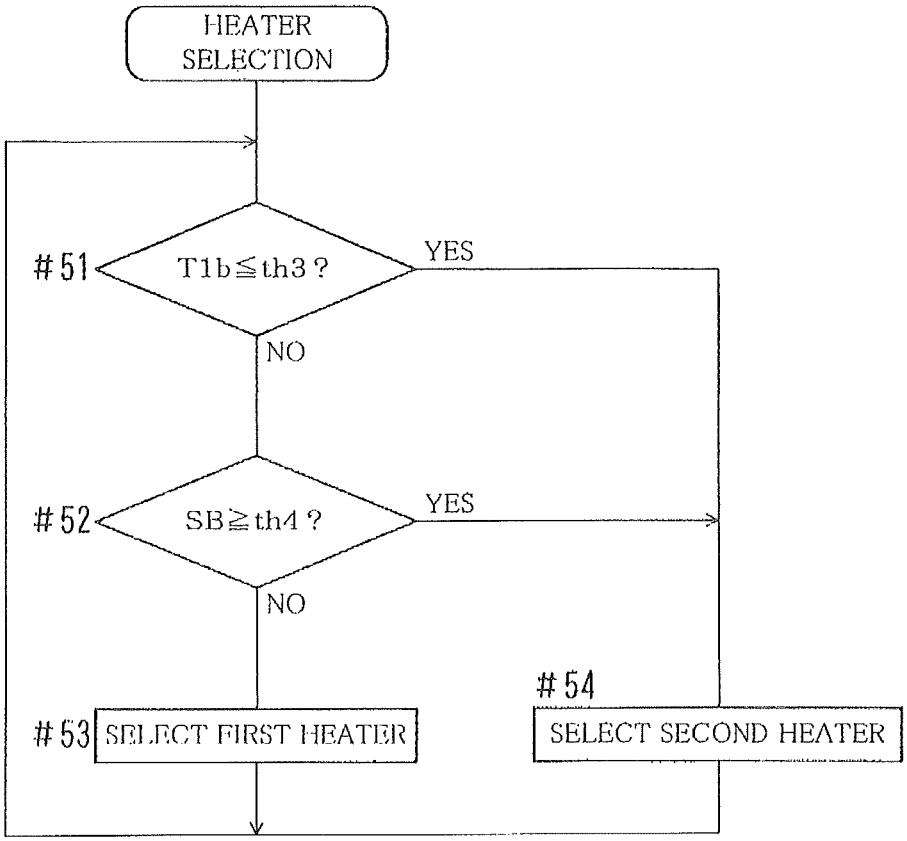
FIG. 11 is a flowchart depicting an example of the outline of heater selection control.

Referring to FIG. 11, in heater selection control under the print mode, when the second temperature T1*b* becomes equal to or smaller than the third threshold th3 (Yes in Step #51), or, alternatively, when the difference SB (=T1*a*−T1*b*) between the second temperature T1*b* and the first temperature T1*a* becomes equal to or greater than the fourth threshold th4 (Yes in Step #52), the second heater 55*b* is selected (Step #54). Otherwise, the first heater 55*a* is selected (Step #53).

Figure 12:
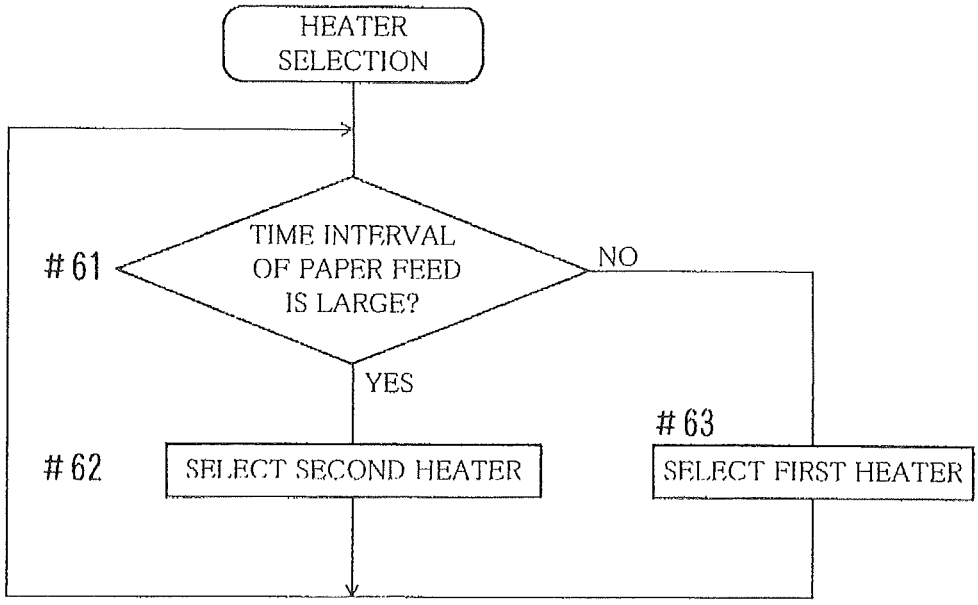
FIG. 12 is a flowchart depicting another example of the outline of heater selection control.

Referring to FIG. 12, in another heater selection control under the print mode, when an interval (time interval or space) between a piece of paper 14 passing through the rollers and the next piece of paper 14 passing therethrough is greater than a predetermined value (Yes in Step #61), the second heater 55*b* is selected (Step 462). Otherwise, the first heater 55*a* is selected (Step #63).

Note that only one of the heater selection control shown in the flowcharts of FIGS. 11 and 12 may be used, or, priority may be given to any one of the heater selection control.

As discussed above, the image forming apparatus GKS of this embodiment is provided with the two heaters 55*a* and 55*b* for heating the heated roller 51. In the distribution of the amount of heat generated in the axial direction of the first heater 55*a*, the amount of heat generated is higher in the ends of the first heater 55*a* than in the center thereof. The maximum value of the total amount of heat generated in the second heater 55*b* is smaller than that of the first heater 55*a*. In the distribution of the amount of heat generated in the axial direction of the second heater 55*b*, the amount of heat generated is higher in the ends of the second heater 55*b* than in the center thereof. Compared to the first heater 55*a*, the second heater 55*b* has a higher ratio of the amount of heat generated in the ends of the second heater 55*b* to the center thereof.

The control is performed as follows: In the warm up mode, both the first heater 55*a* and the second heater 55*b* are selected and supplied with power; in the standby mode, only the second heater 55*b* is selected and supplied with power; and in the print mode, any one of the first heater 55*a* and the second heater 55*b* is selected and supplied with power.

Thereby, the time required for the image forming apparatus GKS to be warmed up is shortened, temperature drop in the ends of a roller at the start of paper feed is minimized, and temperature rise in the ends of the roller during the continuous paper feed is reduced.

In the foregoing embodiment, the fixing unit 30 in the image forming apparatus GKS may be provided with a thermopile or thermocouple as the temperature sensor. The conditions and settings in the fixing unit 30 are not limited to the foregoing examples. The heat source is not limited to the heater. The heat source may be a resistance heating element for example, or, heating by induction is also possible. Instead of the roller fixing, belt fixing may be used. The number of heaters 55 may be three or more. The number of temperature sensors 56 may be three or more.

In the embodiment discussed above, the overall configurations of the heated roller 51, the pressure roller 54, the first heater 55*a*, the second heater 55*b*, the first temperature sensor 56*a*, the second temperature sensor 56*b*, the first control unit 111, the second control unit 112, the storage portion 113, the fixing control unit 20, or the image forming apparatus GKS, the configurations of various portions thereof, the structure, the circuit, the shape, the number, and the layout thereof, the thresholds th1-th4, the power rating, the rate WA, the length value, and the like may be altered as required in accordance with the subject matter of the present invention.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A fixing unit for applying heat to a recording sheet passing through two rollers contacting each other to fix toner onto the recording sheet, the fixing unit comprising:

a first heat source internally provided in one of the rollers and configured to heat the one of the rollers, the first heat source having an amount of heat generated per unit length higher in ends of the first heat source than in a center thereof in a distribution of the amount of heat generated per unit length in an axial direction of said any one of the rollers; and a second heat source internally provided in the one of the rollers that the first heat source is internally provided in and configured to heat the one of the rollers, a maximum value of a total amount of heat generated in the second heat source being smaller than that of the first heat source, the second heat source having an amount of heat generated per unit length higher in ends of the second heat source than in a center thereof in a distribution of the amount of heat generated per unit length in an axial direction of said any one of the rollers, wherein an amount of heat generated per unit length in the ends of the second heat source is higher than an amount of heat generated per unit length in the center of the second heat source by a first ratio, an amount of heat generated per unit length in the ends of the first heat source is higher than an amount of heat generated per unit length in the center of the first heat source by a second ratio, and the first ratio higher than the second ratio.

2. The fixing unit according to claim 1, comprising a power supplying portion configured to supply power to the first heat source and the second heat source, and a first control unit configured to perform control in such a manner that, in a warm up mode, both the first heat source and the second heat source are selected and supplied with power, in a standby mode, only the second heat source is selected and supplied with power, and in a print mode, any one of the first heat source and the second heat source is selected and supplied with power.

3. The fixing unit according to claim 2, comprising a first temperature sensor configured to detect temperature in a center of the roller and around the center of the roller; wherein the first control unit controls the power supplying portion in such a manner that the warm up mode is turned into the standby mode at a time when a first temperature detected by the first temperature sensor after starting the warm up mode reaches a first threshold th1 or greater, and, in a state where the standby mode is turned into the print mode in response to entry of a print mode command, the first temperature reaches a second threshold th2 set as a target temperature or greater, so that an amount of power to be supplied to the first heat source or the second heat source is adjusted.

4. The fixing unit according to claim 3, comprising a second temperature sensor configured to detect temperature in the ends of the roller; wherein in the print mode, the first control unit selects the first heat source at steady state, and the first control unit selects the second heat source at a time when a second temperature detected by the second temperature sensor is not more than a third threshold th3, or, at a time when the second temperature is reduced to be smaller than the first temperature and a difference between the first temperature and the second temperature is not less than a fourth threshold th4.

5. The fixing unit according to claim 3, wherein the first control unit performs the control in the print mode in such a manner that the first heat source is selected at steady state, and, the second heat source is selected when an interval between a recording sheet passing through the rollers and a recording sheet passing next therethrough is greater than a predetermined value.

6. The fixing unit according to claim 1, wherein the second ratio is 110% or more, and the first ratio is 125% or more.

7. The fixing unit according to claim 1, comprising a second control unit configured to perform control in such a manner that the rollers are stopped in the standby mode, the rollers are rotated in the print mode, and the rollers are stopped after the last recording sheet passes through the rollers in the print mode and after a predetermined of time has elapsed since the print mode is turned into the standby mode.

8. The fixing unit according to claim 4, wherein each of the first temperature sensor and the second temperature sensor is a thermistor, and provided not to contact the rollers.

9. The fixing unit according to claim 1, wherein the second heat source has a heated region substantially equal to a maximum width size of the recording sheet, and the first heat source has a heated region slightly smaller than that of the second heat source.

10. The fixing unit according to claim 1, wherein each of the first heat source and the second heat source is a halogen lamp heater, and is provided inside of any one of the rollers.

11. An image forming apparatus comprising a fixing unit according to claim 1.

* * * * *